United States Patent [19]

Heron et al.

[11] Patent Number: 4,878,785

[45] Date of Patent: Nov. 7, 1989

[54] ABRASIVE FLUID FLOW

[75] Inventors: Roger A. Heron, Bedford; David H. Saunders, Buckinghamshire, both of Great Britain

[73] Assignee: The British Hydromechanics Research Association, Bedford, England

[21] Appl. No.: 3,387

[22] PCT Filed: Apr. 24, 1986

[86] PCT No.: PCT/GB86/00224

§ 371 Date: Dec. 10, 1986

§ 102(e) Date: Dec. 10, 1986

[87] PCT Pub. No.: WO86/06311

PCT Pub. Date: Nov. 6, 1986

[30] Foreign Application Priority Data

Apr. 25, 1985 [GB] United Kingdom ..... 8510538

[51] Int. Cl.[4] ..... B65G 53/34

[52] U.S. Cl. ..... 406/194; 406/195; 239/590

[58] Field of Search ..... 406/193, 194, 195, 152; 239/590, 590.5, 591, 468, 490, 589

[56] References Cited

U.S. PATENT DOCUMENTS

| | | | |
|---|---|---|---|
| 1,736,768 | 11/1929 | Boynton | 239/400 |
| 3,212,217 | 10/1965 | Furgason | 239/468 |
| 3,276,821 | 10/1966 | Edwards | 406/193 |
| 3,522,659 | 8/1970 | Welch | 34/22 |
| 4,019,783 | 4/1977 | Kayser | 406/195 X |
| 4,080,762 | 3/1978 | Watson | 51/439 |
| 4,161,280 | 7/1979 | Kasinskas | 239/589 X |
| 4,339,406 | 7/1982 | Underwood | 264/154 |
| 4,478,368 | 10/1984 | Yie | 239/430 |

FOREIGN PATENT DOCUMENTS

| | | | |
|---|---|---|---|
| 0110529 | 6/1984 | European Pat. Off. . | |
| 2030241 | 12/1971 | Fed. Rep. of Germany | 406/194 |
| 2928698 | 2/1981 | Fed. Rep. of Germany . | |
| 2369008 | 5/1978 | France . | |
| 48528 | 3/1982 | Japan | 406/195 |
| 207219 | 12/1983 | Japan | 406/195 |
| 964384 | 10/1982 | U.S.S.R. | 239/589 |

*Primary Examiner*—Joseph F. Peters, Jr.
*Assistant Examiner*—Paul E. Salmon
*Attorney, Agent, or Firm*—Shapiro and Shapiro

[57] ABSTRACT

Abrasive fluid, which includes abrasive material and a carrier fluid, is transported through a conduit with minimum wear by directing the abrasive material along the center of the flow channel within the conduit, accelerating the carrier fluid and entraining the abrasive material within the accelerated carrier fluid. A conduit for performing this method includes a flow channel, means (9) adjacent its upstream section (1) for directing abrasive material along the center of the flow channel, a section (2) of reduced cross-section for accelerating carrier fluid in the flow channel and a down-stream section (3) for accelerating the abrasive material at the center of the flow channel due to entrainment with the accelerated carrier fluid.

14 Claims, 2 Drawing Sheets

ABRASIVE FLUID FLOW

BACKGROUND OF THE INVENTION

An abrasive fluid, that is a fluid with abrasive material entrained therein, causes wear on the surfaces of conduits through which it passes. The object of the present invention is to reduce such wear. It is possible to construct nozzles with one or more grades of wear resistant materials such as ceramics (for example tungsten carbide, silicon carbide, aluminum oxide). These materials have been used in conventional nozzle shapes which are designed to accelerate the flow of fluid without undue loss of energy and without introducing disturbance which would cause the resulting high velocity jet of fluid to break up. When such nozzles are used with abrasive fluids, the particles of material still cause some wear on contact with the internal surfaces of the nozzle and they will be slowed down by impact with the nozzle. The present invention has the object of directing the abrasive material in abrasive fluids away from the internal surfaces of the nozzle in order to reduce such impact.

SUMMARY OF THE INVENTION

According to one aspect of the invention there is provided a method of transporting an abrasive fluid containing abrasive material and carrier fluid through a conduit, comprising directing the abrasive material along the center of the flow channel within the conduit, accelerating the carrier fluid and entraining the abrasive material within the accelerated carrier fluid. According to another aspect of the invention there is provided a fluid flow conduit comprising a flow channel, means adjacent to the upstream section of the conduit for directing abrasive material along the center of the flow channel, a section of reduced cross section for accelerating carrier fluid in the flow channel and a down-stream section for accelerating the abrasive material at the center of the flow channel due to entrainment with the accelerated carrier fluid.

BRIEF DESCRIPTION OF THE DRAWINGS

Examples of the invention will now be described as reference to the accompanying drawings in which.

DETAILED DESCRIPTION OF THE INVENTION

Figure 1:
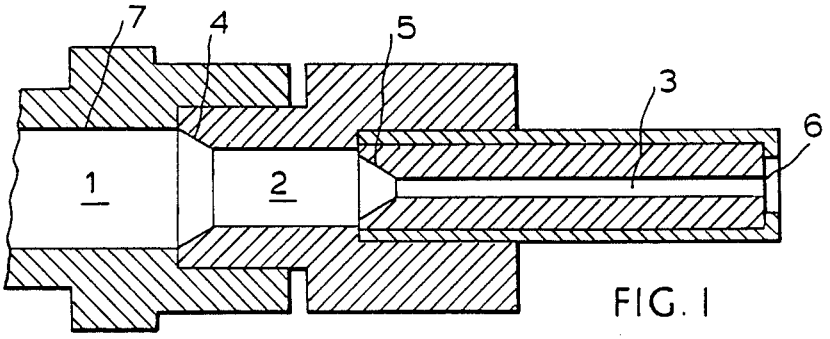
FIG. 1 is a diametral cross-section through a nozzle assembly.
Figure 2:
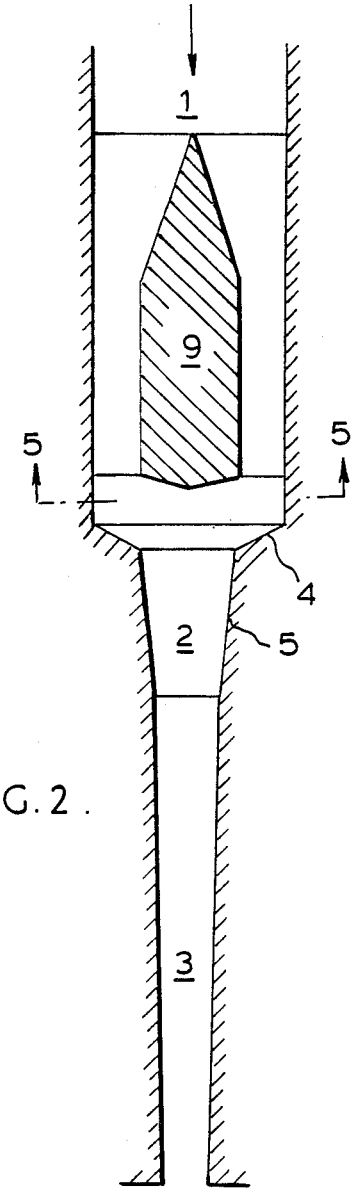
FIGS. 2 to 4 are schematic diametral cross-sections through alternative nozzle assemblies.
Figure 3:
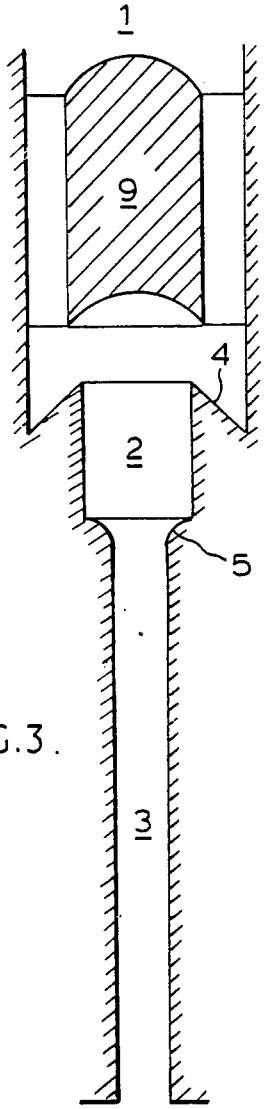
Figure 4:
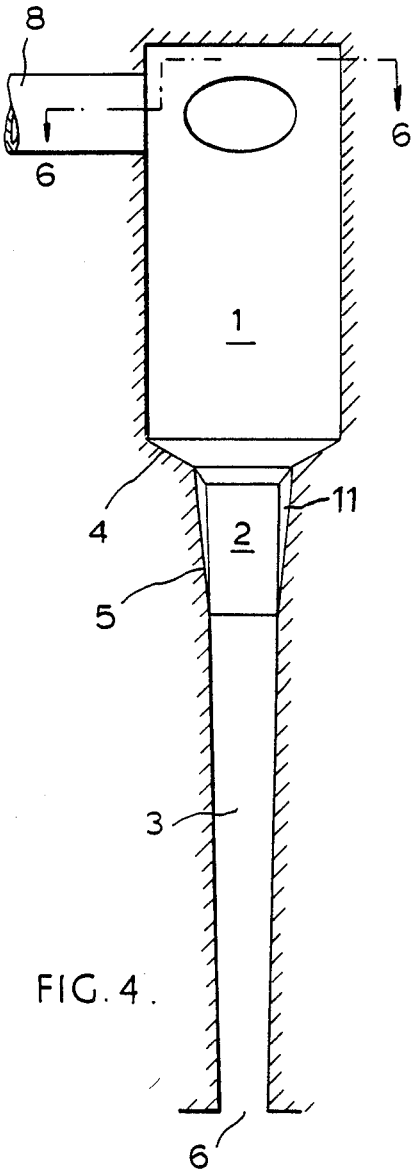
Figure 5:
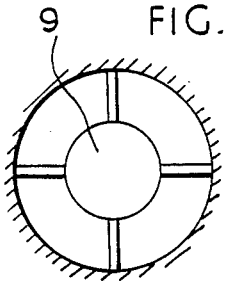
FIG. 5 is a view on lines 5–5 in FIG. 2.
Figure 6:
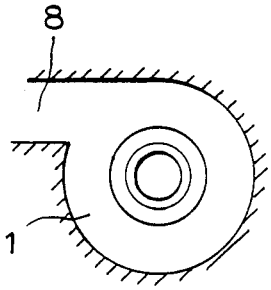
FIG. 6 is a view on lines 6–6 on FIG. 4.

In the nozzle assembly of FIG. 1, abrasive fluid enters the up-stream section 1 of relatively large cross-section and abrasive material within the fluid is deflected towards the center of the flow channel by a tapered portion 4 between the up-stream section 1 and a mid-stream section 2. The carrier fluid tends to flow in stream-line manner in contact with the internal surfaces of the flow channels 1 and 2, whereas the abrasive material tends to be deflected by the tapered portion 4 towards the center of the flow channel within the section 2. Down-stream of the mid-stream section 2 is a further tapered portion 5 which causes the carrier fluid to accelerate due to its decreasing cross-section, and as the abrasive fluid flows through the down-stream section 3 following the tapered section 5, there is an interchange of momentum between the carrier fluid and the abrasive material flowing in the center of the flow channel, so that the abrasive material is accelerated and leaves the outlet 6 of the nozzle assembly at high velocity. It will be noted that there is a small shoulder between the mid-stream section 2 and the entrance to the tapered section 5, and the down-stream section 3 is enclosed within a cover whose outlet surface has a greater diameter than the down-stream section 3. Typical dimensions of such a nozzle assembly include diameters of 17.0, 11.3 and 2.8 mm respectively for the up-stream section 1, mid-stream section 2 and down-stream section 3, an entrance diameter of 9.5 mm for the tapered section 5, a lenght of 27 mm for the tapered section 4 and mid-stream section 2 together, and a lenght of 60 mm for the tapered section 5 and down-stream section 3 together. The outer diameter of the down-stream section 3 is 12mm. The tapers of the sections 4 and 5 can be widely varied to achieve the desired effect of deflection of the abrasive material and acceleration of the carrier fluid, as will be seen from comparision of FIGS. 1 to 4. In FIG. 2,the angle of taper of the section 4 is much greater, and the mid-stream section 2 and the tapered section 5 are combined into a single section of uniform taper and the down-stream section 3 is also tapered, to a smaller degree than the mid-stream section. A central flow deflector 9 is mounted in the center of the up-stream section 1, supported by radial vanes as shown in FIG. 5. The flow deflector 9 has a conical up-stream section, a cyclindrical mid-stream section and a conical down-stream section of very large included angle. The flow deflector serves to deflect particles towards the outside of the flow channel in section 1, so that the tapered section 4 which has an included angle of about 120° C. is able to deflect the particles to the center of the flow channel in the mid-stream section 2. In the apparatus of FIG. 3, the tapered section 4 has an included angle of more than 180° C., in this case about 270° C. This arrangement is particularly suitable when the abrasive material comprises large particles of high density. The flow deflector 9 has a domed up-stream portion and a re-entrant domed down-stream portion. The tapered portion 5 is in this case rounded and seperate from the mid-stream portion, which is cylindrical. The down-stream portion 3 is also cylindrical. In FIG. 4,the geometry of FIG. 2 is followed, except that the flow deflector 9 is replaced by a centrifugal entry system 8, more clearly seen in the view in FIG. 6, by which abrasive fluid enters the up-stream section tangentially so that abrasive material tends to flow around the outside of the up-stream section in a spiral flow before deflection by the tapered portion 4. A number of ribs 11 are provided in the tapered mid-stream section to prevent the spiral flow of fluid extending through that section. This prevents abrasive material which has been deflected to the center of the flow channel by the tapered portion 4 from being carried to the outside of that section by further centrifugal action. The ribs 11 do not extend to the center of the section 2 and consequently do not interfere with the abrasive particles which are concentrated at the center of the flow channel.

We claim :

1. A nozzle for forming an abrasive fluid jet, comprising a fluid conduit having an inlet section of relatively large cross section into which an abrasive particulate material is to be introduced with a carrier fluid, flow deflector means mounted substantially centrally within said inlet section for deflecting the abrasive material outwardly toward the periphery of said inlet section, means comprising a first tapered section disposed down-stream from said inlet section for deflecting the abrasive material toward a central axis of said fluid conduit to form a core of the abrasive material surrounded by the carrier fluid, means comprising a second tapered section disposed down-stream from said first tapered section for accelerating the carrier fluid, and means comprising an outlet section disposed down-stream from said second section for affecting an interchange of momentum between the accelerated carrier fluid and the abrasive material such that the abrasive material is accelerated to a high velocity.

2. A nozzle according to claim 1, wherein said deflector means has a domed up-stream end and a re-entrant down-stream end, and said first tapered section comprises a tapered surface having an included angle of more than 180° C.

3. A nozzle according to claim 2, wherein said deflector means has a cylindrical midsection.

4. A nozzle according to claim 2, wherein said included angle is about 270° C.

5. A nozzle according to claim 2, wherein said fluid has a non-tapered mid-stream section disposed between said first tapered section and said second tapered section.

6. A nozzle according to claim 5, wherein said second tapered section comprises an inwardly rounded surface which reduces in diameter in a down-stream direction.

7. A nozzle according to claim 1, wherein said deflector means has a conical up-stream end with a relatively small included angle and a conical down-stream end with a relatively large included angle.

8. A nozzle according to claim 7,wherein said first tapered section comprises a tapered surface with an included angle of about 120° C.

9. A nozzle for forming an abrasive fluid jet, comprising a fluid conduit including an inlet section having tangential inlet means toward an up-stream end thereof for the introduction of an abrasive particulate material with a carrier fluid such that the abrasive material tends to flow near the outside of said inlet section in a spiral manner, means comprising a first tapered section disposed down-stream from said inlet section for deflecting the abrasive material toward a central axis of said fluid conduit such that the abrasive material concentrates in a central portion of said fluid conduit, means disposed down-stream from said first tapered section and including at least one axially extending peripheral rib and a second tapered section for accelerating the carrier fluid and preventing further spiral flow of the abrasive material, and means comprising an outlet section disposed down-stream of the last-mentioned means for effecting an interchange of momentum between the acclerated carrier fluid and the abrasive material such that the abrasive material is accelerated to a high velocity.

10. A nozzle according to claim 9, wherein said peripheral rib is disposed within said second tapered section.

11. A method of transporting an abrasive fluid containing an abrasive particulate material and a carrier fluid through a fluid conduit having an inner periphery, comprising introducing the abrasive material and carrier fluid of the abrasive fluid together, as a mixture, into an inlet section of the conduit, directing the abrasive material from near the inner periphery of the conduit inward toward a central axis of the conduit in a second section of the conduit down-stream from said inlet section , thereby causing the carrier fluid to flow more near the inner periphery of the conduit and the abrasive material to concentrate and flow more near the central axis, accelerating the carrier fluid in a third section of the conduit down-stream from the second section, and effecting an interchange of momentum between the accelerated carrier fluid and the abrasive material in a fourth section of the conduit down-stream from the third section in order to accelerate the abrasive material.

12. The method of claim 11, wherein the directing step comprises deflecting the abrasive material with a tapered surface of the conduit.

13. The method of claim 11, wherein the accelerating step comprises passing the carrier fluid and abrasive material through a tapered portion of the conduit.

14. The method of claim 11, wherein said mixture is introduced tangentially into the inlet section to assume a spiral flow, and further including preventing spiral flow of the centrally directed abrasive material by means of at least one axially extending peripheral rib of the conduit.

* * * * *